United States Patent [19]

Brown

[11] Patent Number: 4,531,346

[45] Date of Patent: Jul. 30, 1985

[54] STIRRUP STAY

[75] Inventor: Milton D. Brown, Englewood, Colo.

[73] Assignee: Barbara A. Brown, Hill City, S. Dak.

[21] Appl. No.: 428,178

[22] Filed: Sep. 29, 1982

[51] Int. Cl.[3] ..... B68C 1/16

[52] U.S. Cl. ..... 54/46

[58] Field of Search ..... 54/46, 47, 48, 49

[56] References Cited

U.S. PATENT DOCUMENTS 792,228 6/1905 Mills ..... 54/47

2,482,153 9/1949 Cavin ..... 54/46

*Primary Examiner*—Robert P. Swiatek

*Assistant Examiner*—Kris R. Schulze

*Attorney, Agent, or Firm*—Kyle W. Rost

[57] ABSTRACT

A stirrup stay for adjusting the horizontal angle of a horse saddle stirrup is constructed from a strip of sheet material that is adapted to be received in the space between the inner and outer portions of a stirrup strap and resting in the loop at the bottom of the strap. The strip of sheet material is hand-deformable by twisting to selectively impart the desired degree of twist to the stirrup strap. The strip may be formed from sheet metal having a cushioning coating protecting a majority of the edges. In one embodiment, a sheet metal strip is bent by 180 degrees near its center to bring opposite longitudinal ends together, and the opposite halves of the strip are covered by a sheath of leather, rubber, or other yieldable material. A central portion of the strip near the bend may remain uncovered and is protected, in use, by placement of the stirrup with its pivot pin resting in the bend.

1 Claim, 5 Drawing Figures

STIRRUP STAY

BACKGROUND OF THE INVENTION

1. Field of the Invention

The invention relates to harness and specifically to stirrups. A device is disclosed for use in combination with a standard stirrup and its stirrup strap for selectively altering the position in which the stirrup opening hangs.

2. Description of the Prior Art

A horse saddle stirrup ordinarily hangs from the saddle leather or stirrup strap in such a position that the stirrup opening faces a side of the animal's body. Many devices have been proposed to alter this stirrup orientation by approximately ninety degrees, so that the opening faces the front-to-rear direction of movement and is immediately in the correct position to receive a rider's foot. Because the saddle leather simply hangs in a loop from the side of the saddle, and particularly with western saddles, the width of the fender causes the leather to lie against the horse's body in a reasonably flat condition, most prior proposals have involved a stirrup bracket having two horizontal mounting axes at right angles to each other. A pin following one of the axes is suspended in the loop of the saddle leather, and a pin or other mounting device following a perpendicular axis is attached across the opposite sides of the stirrup. The result of such a mounting is that the stirrup is permanently facing a front-to-rear position with respect to the horse's body.

Representative U.S. patents illustrating the state of the art as noted above include U.S. Pat. Nos. Re. 9,244 to Flora, 295,129 to Nolen, 482,996 to Dacus, and 985,799 to Harper. Variations of such right angle repositioning are known wherein the stirrup is also moved laterally of the horse's body and saddle leather by a nonsymmetrical suspension of the stirrup. U.S. Pat. Nos. 33,930 to Eagle and 2,978,855 to Horst illustrate such an offset mounting of the stirrup.

While it is evident that a mechanical bracket can be employed to orient a stirrup in any angular position and at various degrees of offset from the suspension point, a problem that attaches to all such brackets is that the stirrup could present a danger to the horse in the event of a sideways fall unless the stirrup is free to return to a position parallel to the horse's body. The first mentioned group of brackets having right angle axes makes no provision for returning the stirrup to such a parallel position. In addition, this group makes no provision for selectivity in stirrup orientation. In the second group, and particularly with respect to the Horst patent, the more complex brackets offer no improvement in protection for the horse and may present a larger body that could injure the horse in a fall. It therefore remains desirable to eliminate bulk from the stirrup, to allow for the selection of a stirrup angle, and to permit return of the stirrup to parallel position with the horse's body in the event of a fall.

A presently preferred technique for setting a stirrup angle is to wet the stirrup strap and permit this leather to dry while held in the desired degree of twist. U.S. Pat. No. 3,827,215 to Edenfield discloses a tool for holding the stirrup in twisted position while the leather dries. Although this technique can be used without adding hardware to the stirrup, it is not entirely reliable and does require considerable advance preparation before the strap can be used.

The present invention offers a solution to the various short-comings of the prior art, as will be described below.

SUMMARY OF THE INVENTION

A stirrup stay for adjusting the horizontal angle of a horse saddle stirrup includes an elongated strip of sheet metal material that is receivable between the inner and outer portions of a stirrup strap. The metal strip is of a suitable thickness and strength to be hand-deformable by twisting force applied about a longitudinal axis of the strip for imparting a corresponding twist to the stirrup strap. Means is provided for retaining the metal strip between the inner and outer portions of the stirrup strap. Such means may include a receptacle for the stirrup pivot pin, whereby the presence of the stirrup with its pivot pin being received in the loop of the stirrup strap also maintains the stirrup stay in the loop of the strap.

A yieldable cushioning means covers at least a major portion of the edges of the strip for preventing direct contact between the edges and the horse, in the event that the strip should come into contact with the horse due to unexpected circumstances. Suitable coverings include leather, rubber, plastic and the like. The covering may be applied in the form of a sheath over all or part of the strip, or the strip may be coated to any desired degree of coverage.

The strip may include both inner and outer strip lengths joined together by a U-shaped lower junction serving as the retaining means and adapted to rest in the loop of the stirrup strap with the stirrup pivot pin resting in the U-shaped junction. Such a configuration may be formed from a single elongated strip of sheet metal that is bent together at its opposite ends, causing a central bend at the approximate mid-point in the length of the strip. Because the stirrup pivot pin is received in the bend, it is generally not necessary for the edges of the metal strip to be cushioned in the immediate vacinity of the bend. However, it is desirable for the opposite end portions of the strip to be cushioned to within a small distance from the bend.

The main object of the invention is to provide a device that will allow the instant and selective shaping of the stirrup strap and fender in order to position the stirrup at any desired horizontal angle with respect to the horse.

An important object is to provide a desired positioning of the stirrup while protecting the horse against injury. In this regard, the stirrup stay is capable of hand twisting not only to permit adjustment by the rider, but also to leave open the possibility of automatic untwisting action if a hard impact should strike the stirrup stay. In addition, cushioning material is applied to the stirrup stay to further protect the horse.

DESCRIPTION OF THE PREFERRED EMBODIMENT

Figure 1:
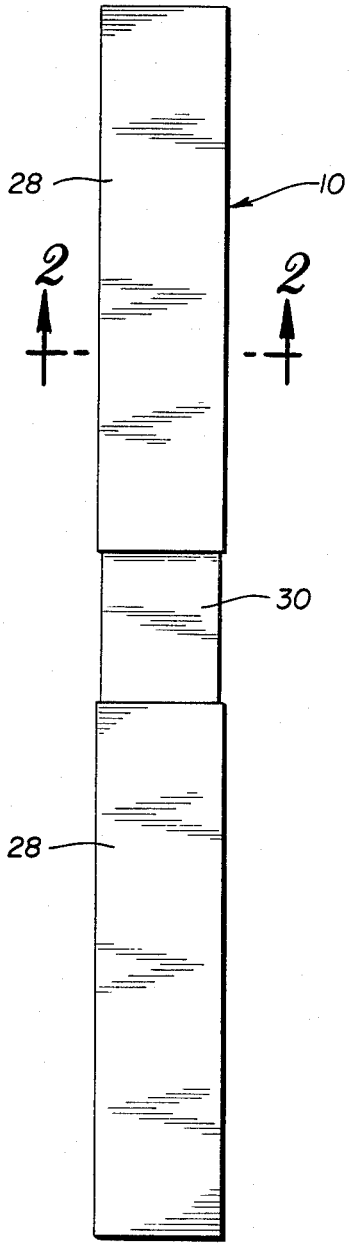
FIG. 1 is a front view of a stirrup stay in unfolded configuration.
Figure 2:
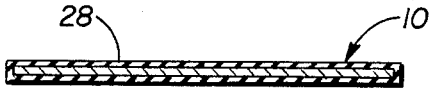
FIG. 2 is a cross-sectional view taken along the plane of line 2—2 of FIG. 1.

The stirrup stay 10 is best shown in FIGS. 1–4 to be an elongated member formed from a flexible material that is capable of being deformed and retaining the deformed shape. The stirrup stay is intended for use with a saddle of conventional western design for use on a horse. The stirrups 12 of such saddles are hung from a pivot pin 14 that conventionally is received in a loop of a stirrup strap 16, FIG. 5, from which the stirrup hangs. The strap is typically the lower extension of the fender 18, which is formed from leather and hangs from the saddle at the horse's side. Due to this construction, the strap 16 is generally parallel to the fender and carries the stirrup pivot pin 14 in a front-to-rear direction relative to the saddle and horse. The fender and stirrup straps offer flexibility so that the rider can turn the stirrup with his foot to any desired horizontal angle.

The stirrup stay supplements the structure of such a conventional western saddle by serving as a deformable insert in the stirrup strap. Member 10 may be inserted between the inner and outer portions of strap 16 with the longitudinal axis of the stay in a generally vertical position with respect to the normal hanging position of the strap and stirrup. The stirrup stay is retained between the strap portions by a suitable means, which may include conventional belt 20 around the strap or a receptacle for receiving the stirrup pivot pin. When thus received and retained, the stay is capable of influencing the horizontal angle of the stirrup by impressing its own deformation upon the hanging position of the strap and fender.

The stirrup pivot pin 14 may be engaged by the stirrup stay in a central fold or bend 22 formed by bringing the opposite longitudinal ends of the elongated member 10 together. The resulting structure has an inner strip length 24 and an outer strip length 26 connected at a U-shaped lower Junction 22. The stirrup pivot pin rests in the junction 22, which in turn rests in the loop of the stirrup strap 16. The inner and outer strip portions 24 and 26 extend above the stirrup and between inner and outer portions of the stirrup strap, which protect the horse from contact with the stay.

Figure 5:
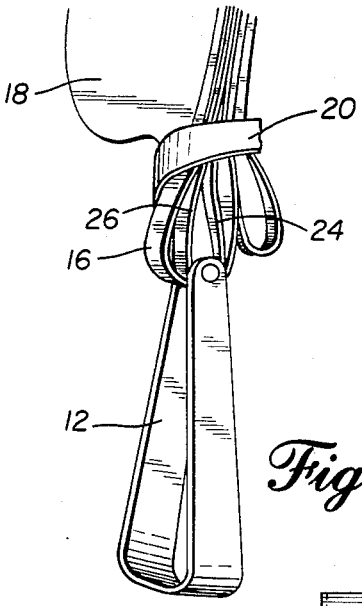
FIG. 5 is an isometric view of the stirrup stay as installed in the loop of a saddle stirrup strap.
Figure 3:
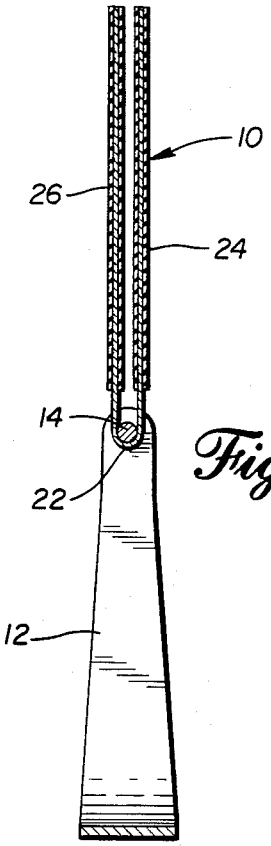
FIG. 3 is a side view of a stirrup stay in folded position and with a stirrup hung in the bend.
Figure 4:
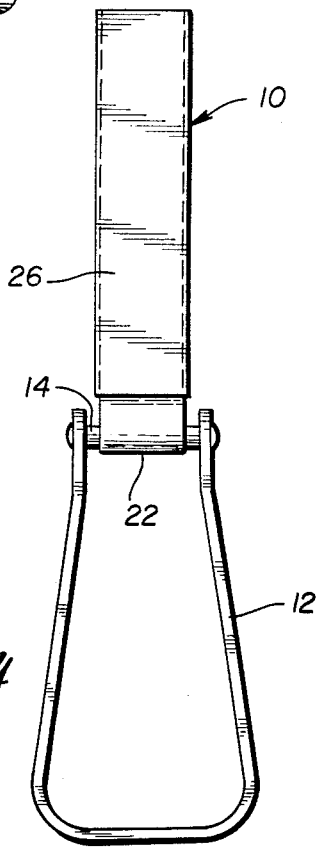
FIG. 4 is a front view of FIG. 3.

A yieldable cushioning means is applied to the edges of the stirrup stay for preventing direct contact between the edges and the horse, in the event that any part of the stirrup stay should be exposed outside the stirrup strap loop. The U-shaped lower junction 22 need not be so protected in view of the protection offered by the stirrup itself, as can be seen in FIGS. 3–5. The protective cushioning means may include sheaths 28 covering stay portions 24 and 26. Leather is a preferred material for sheaths 28, as it offers both strength and flexibility. Rubber sheaths are also suitable, and can be either premolded or applied directly to the ends of the stay. Other suitable materials include plastics and elastomers.

The specific construction of the stirrup stay 10 indicates suitable materials and dimensions for the majority of western saddles. A base or body 30 is formed from metal having a sufficient thickness to retain a given shape against the general magnitude of forces encountered by a stirrup strap. At the same time, the metal should be thin enough to be hand-deformable by twisting, so that a rider can adjust the stirrup angle without tools and so that the stay has the potential to be automatically flattened if the horse should fall. Galvanized sheet steel of 20 gauge has been found to be one satisfactory material. An elongated strip of such metal may have a length of two feet and a width in the range from $1\frac{1}{2}$ to $2\frac{1}{2}$ inches in one-half inch increments, which correspond to the approximate sizes desired to receive stirrups of commercial manufacture. The protective sheath or covering 28 is applied to each longitudinal end of the body 30 and covers approximately $10\frac{1}{2}$ inches of the body length, leaving approximately three inches of uncovered metal at the center of the body length. The elongated body is bent across the width of the center portion to create a 180 degree bend, bringing the opposite longitudinal ends together.

In use, the stirrup stay receives the pivot pin of a stirrup in the bend 22, and the stirrup strap is brought under the bend and secured to create a loop that supports the stirrup stay and stirrup from the saddle. The stay can then be twisted by hand force to rotate the angular orientation of the bend 22 with respect to the opposite free ends of the stay. The resulting structure of the stay includes an upper end oriented in a first vertical plane and a lower stirrup supporting end oriented in a second vertical plane that is at at least an acute angle to the first plane. Between the two ends, the stay is configured in a helical pattern or such other pattern as may be given by the hand forces that are applied.

The invention has been described in detail with particular reference to the preferred embodiments, but is to be understood that variations and modifications can be effected within the spirit and scope of the invention.

I claim:

1. A device for selectively adjusting the horizontal angle of a western style horse saddle stirrup of the kind suspended from a stirrup strap with an adjustably wrapped loop at the lower end of a saddle fender by a pivot pin received in a loop of the strap, comprising:

(a) an elongated strip of sheet material that is received between inner and outer portions of a stirrup strap and rests in the loop of the stirrup strap, wherein said elongated strip is formed from a material having the flexible, deformable characteristics of sheet metal so as to be deformable under the weight of a fallen horse and to be hand deformable by twisting forces applied about a vertical longitudinal axis thereof for imparting a corresponding twist to the stirrup strap, the elongated strip comprising an inner arm and an outer arm of approximately equal length and, in use, extending upwardly between the inner and outer portions of the stirrup strap, joined together by a U-shaped central portion at the base of the arms that holds the inner and outer arms together;

(b) a yieldable cushioning means covering at least a major portion of said inner arm and outer arm between said inner and outer portions of the stirrup strap for maintaining the arms together; and (c) wherein, in use, said U-shaped central portion receives the pivot pin of a stirrup and maintains the elongated strip of sheet material between the inner and outer portions of the stirrup strap.

* * * * *